US010996596B2

(12) United States Patent
Fujiwara

(10) Patent No.: US 10,996,596 B2
(45) Date of Patent: May 4, 2021

(54) FIXING DEVICE INCLUDING A NIP FORMATION PAD MOVABLE WITH RESPECT TO A GUIDE

(71) Applicant: Hitoshi Fujiwara, Kanagawa (JP)

(72) Inventor: Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/916,390

(22) Filed: Jun. 30, 2020

(65) Prior Publication Data

US 2021/0041814 A1 Feb. 11, 2021

(30) Foreign Application Priority Data

Aug. 6, 2019 (JP) ..... JP2019-144479
Oct. 24, 2019 (JP) ..... JP2019-193690

(51) Int. Cl.
*G03G 15/20* (2006.01)

(52) U.S. Cl.
CPC ..... *G03G 15/2028* (2013.01); *G03G 15/2053* (2013.01); *G03G 15/2064* (2013.01); *G03G 15/2032* (2013.01); *G03G 2215/2016* (2013.01)

(58) Field of Classification Search
CPC ..... G03G 15/2028; G03G 15/2064; G03G 2215/2016; G03G 15/2032; G03G 15/2053; G03G 2215/2035; G03G 2215/2041
See application file for complete search history.

(56) References Cited

U.S. PATENT DOCUMENTS

2012/0121303 A1 5/2012 Takagi et al.
2012/0148303 A1 6/2012 Yamaguchi et al.
2014/0099146 A1* 4/2014 Fuju ..... G03G 15/206 399/122
2016/0011550 A1 1/2016 Utsunomiya et al.
(Continued)

FOREIGN PATENT DOCUMENTS

JP 2005-300732 10/2005
JP 2012-118488 6/2012
(Continued)

OTHER PUBLICATIONS

U.S. Appl. No. 16/750,066, filed Jan. 23, 2020, Hitoshi Fujiwara.
(Continued)

*Primary Examiner* — Walter L Lindsay, Jr.
*Assistant Examiner* — Laura Roth
(74) *Attorney, Agent, or Firm* — Oblon, McClelland, Maier & Neustadt, L.L.P.

(57) ABSTRACT

A fixing device includes a first rotator having an endless form, a second rotator, a heater arranged in at least one of the first rotator and the second rotator, a guide facing an end of the first rotator, and a nip formation pad that is in contact with the second rotator via the first rotator to form a nip between the second rotator and the nip formation pad. The second rotator is configured to move between a pressing position at which the second rotator presses the first rotator and a non-pressing position at which the second rotator does not press the first rotator. The nip formation pad is configured to separate from the guide when the second rotator is at the pressing position.

5 Claims, 7 Drawing Sheets

(56) References Cited

U.S. PATENT DOCUMENTS

| | | | | |
|---|---|---|---|---|
| 2016/0187822 | A1* | 6/2016 | Fukuhata | G03G 15/2064 399/329 |
| 2018/0259887 | A1* | 9/2018 | Kikuchi | G03G 15/2017 |
| 2018/0329342 | A1* | 11/2018 | Seshita | G03G 15/2025 |
| 2019/0294085 | A1* | 9/2019 | Kikuchi | G03G 15/2028 |

FOREIGN PATENT DOCUMENTS

| | | |
|---|---|---|
| JP | 2012-128074 | 7/2012 |
| JP | 2016-018160 | 2/2016 |
| JP | 2017-062392 | 3/2017 |

OTHER PUBLICATIONS

U.S. Appl. No. 16/869,737, filed May 8, 2020, Hitoshi Fujiwara, et al.
U.S. Appl. No. 16/874,089, filed May 14, 2020, Ryohei Matsuda, et al.
U.S. Appl. No. 16/897,343, filed Jun. 10, 2020, Takuya Seshita, et al.

* cited by examiner

FIXING DEVICE INCLUDING A NIP FORMATION PAD MOVABLE WITH RESPECT TO A GUIDE

CROSS-REFERENCE TO RELATED APPLICATIONS

This patent application is based on and claims priority pursuant to 35 U.S.C. § 119 to Japanese Patent Applications No. 2019-144479, filed on Aug. 6, 2019 and No. 2019-193690, filed on Oct. 24, 2019 in the Japan Patent Office, the entire disclosure of which is hereby incorporated by reference herein.

BACKGROUND

Technical Field

Embodiments of the present disclosure generally relate to a fixing device and an image forming apparatus incorporating the fixing device.

Background Art

One type of fixing device includes a rotatable endless first rotator, a rotatable second rotator configured to be located at two positions that are a pressing position to press the first rotator and a non-pressing position, a nip formation pad configured to contact the second rotator via the first rotator and form a nip between the first rotator and the second rotator, guides disposed at both end portions of the first rotator and configured to guide a rotation trajectory of the first rotator, and a heat source disposed in at least one of the first rotator and the second rotator.

SUMMARY

This specification describes an improved fixing device that includes a first rotator having an endless form, a second rotator, a heater arranged in at least one of the first rotator and the second rotator, a guide facing an end of the first rotator, and a nip formation pad that is in contact with the second rotator via the first rotator to form a nip between the second rotator and the nip formation pad. The second rotator is configured to move between a pressing position at which the second rotator presses the first rotator and a non-pressing position at which the second rotator does not press the first rotator. The nip formation pad is configured to separate from the guide when the second rotator is at the pressing position.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
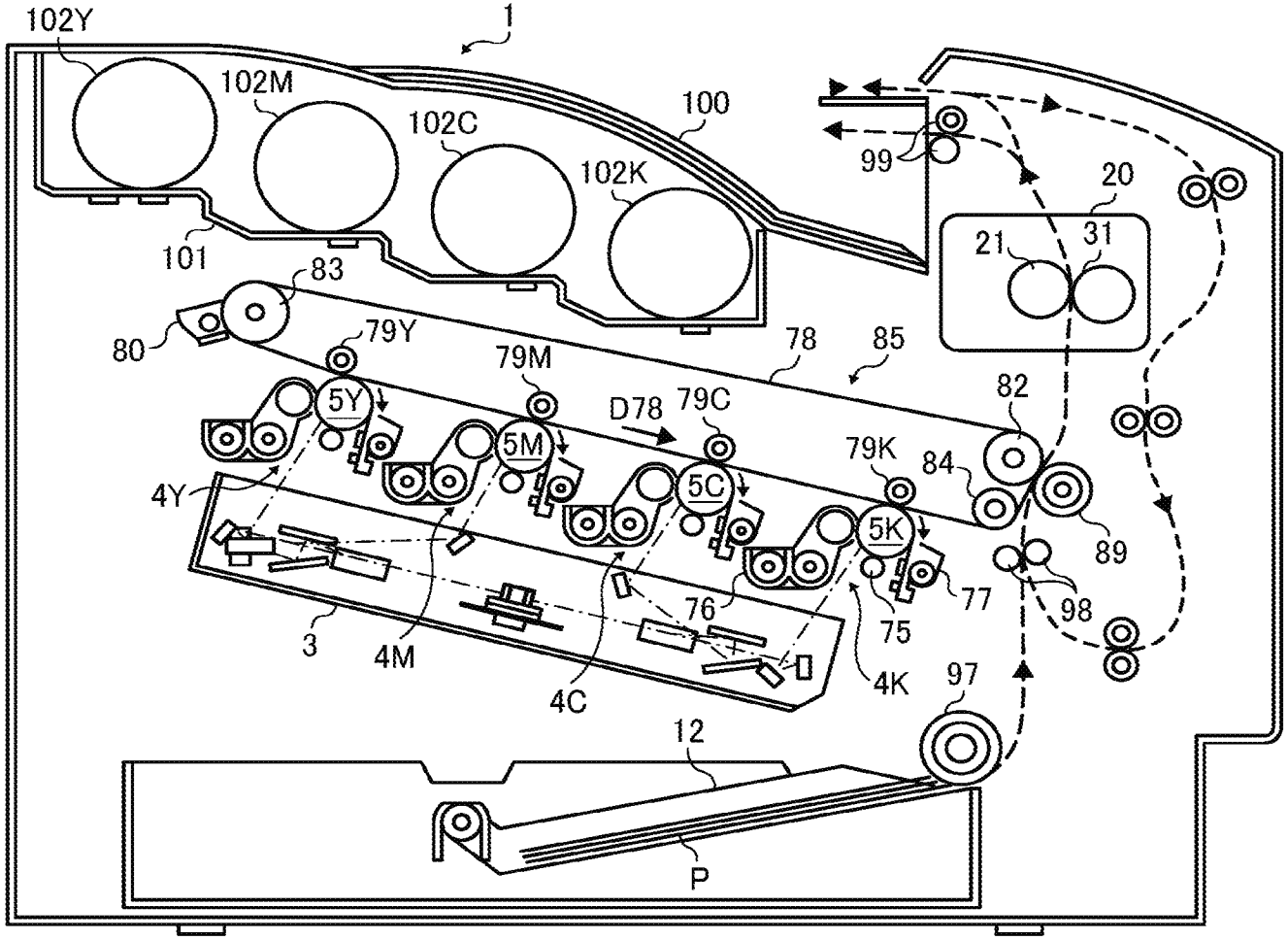
FIG. 1 is a schematic view illustrating a configuration of an image forming apparatus according to a present embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring to the drawings, embodiments of the present disclosure are described below.

Identical reference numerals are assigned to identical components or equivalents and a description of those components is simplified or omitted.

As an image forming apparatus including a fixing device to which the present disclosure is applied, one embodiment of a color electrophotographic image forming apparatus (hereinafter, referred to as an image forming apparatus 1) is described below.

FIG. 1 is a schematic view illustrating a configuration of the image forming apparatus 1 according to a present embodiment.

As illustrated in FIG. 1, the image forming apparatus 1 according to the present embodiment is a tandem-type color printer.

A bottle container 101 is disposed in an upper portion of a main body of the image forming apparatus 1. The bottle container 101 includes four toner bottles 102Y, 102M, 102C and 102K, which are removable from the bottle container 101, and therefore replaceable. The toner bottles 102Y, 102M, 102C and 102K contain toner of yellow, magenta, cyan and black, respectively. It is to be noted that, in the following description, suffixes Y, M, C and K denote colors yellow, magenta, cyan and black, respectively. To simplify the description, these suffixes are omitted unless necessary.

Under the bottle container 101, an intermediate transfer unit 85 is disposed. Facing an intermediate transfer belt 78 of the intermediate transfer unit 85, image forming devices 4Y, 4M, 4C, and 4K are arranged side by side to form toner images of yellow, magenta, cyan, and black, respectively. The image forming devices 4Y, 4M, 4C, and 4K include photoconductor drums 5Y, 5M, 5C, and 5K, respectively. Each of the photoconductor drums 5Y, 5M, 5C, and 5K is surrounded by a charger 75, a developing device 76, a cleaner 77, a discharger, and the like. On each of the photoconductor drums 5Y, 5M, 5C, and 5K, image forming processes including a charging process, an exposure process, a developing process, a primary transfer process, and a cleaning process are performed, forming yellow, magenta, cyan, and black toner images on the photoconductor drums 5Y, 5M, 5C, and 5K, respectively.

A drive motor drives and rotates the photoconductor drums 5Y, 5M, 5C, and 5K clockwise in FIG. 1. The charger 75 disposed opposite each of the photoconductor drums 5Y, 5M, 5C, and 5K uniformly charges the outer circumferential surface thereof in the charging process. After the charging process, the charged outer circumferential surface of each of the photoconductor drums 5Y, 5M, 5C, and 5K reaches an irradiation position at which an exposure device 3 irradiates and scans the photoconductor drums 5Y, 5M, 5C, and 5K with laser beams L, irradiating and scanning the photoconductor drums 5Y, 5M, 5C, and 5K with the laser beams L forms electrostatic latent images according to yellow, magenta, cyan, and black image data in the exposure process. After the exposure process, the irradiated and scanned outer circumferential surface of each of the photoconductor drums 5Y, 5M, 5C, and 5K reaches a developing position at which the developing device 76 is disposed opposite each of the photoconductor drums 5Y, 5M, 5C, and 5K, and the developing device 76 develops the electrostatic latent image formed on the respective photoconductor drums 5Y, 5M, 5C, and 5K, thus forming yellow, magenta, cyan, and black toner images on the photoconductor drums 5Y, 5M, 5C, and 5K in the developing process. After the developing process, the yellow, magenta, cyan, and black toner images formed on the photoconductor drums 5Y, 5M, 5C, and 5K reach primary transfer nips formed between the photoconductor drums 5Y, 5M, 5C, and 5K and the intermediate transfer belt 78 by four primary transfer bias rollers 79Y, 79M, 79C, and 79K pressed against the four photoconductor drums 5Y, 5M, 5C, and 5K via the intermediate transfer belt 78, respectively, and the yellow, magenta, cyan, and black toner images formed on the photoconductor drums 5Y, 5M, 5C, and 5K, respectively, are primarily transferred onto the intermediate transfer belt 78 in a primary transfer process. After the primary transfer process, residual toner failed to be transferred onto the intermediate transfer belt 78 remains on the photoconductor drums 5Y, 5M, 5C, and 5K slightly. After the primary transfer process, the residual toner on each of the photoconductor drums 5Y, 5M, 5C, and 5K reaches a cleaning position at which the cleaner 77 is disposed opposite each of the photoconductor drums 5Y, 5M, 5C, and 5K, and a cleaning blade of the cleaner 77 mechanically collects the residual toner from each of the photoconductive drums 5Y, 5M, 5C, and 5K in the cleaning process. Finally, the cleaned outer circumferential surface of each of the photoconductor drums 5Y, 5M, 5C, and 5K reaches a discharging position at which the discharger is disposed opposite each of the photoconductor drums 5Y, 5M, 5C, and 5K, and the discharger eliminates residual potential from each of the photoconductor drums 5Y, 5M, 5C, and 5K.

Thus, a series of image forming processes performed on the photoconductor drums 5Y, 5M, 5C, and 5K is finished. The toner images formed on the photoconductor drums 5Y, 5M, 5C, and 5K through the developing process are transferred therefrom and superimposed on the intermediate transfer belt 78. Thus, a multicolor toner image is formed on the intermediate transfer belt 78.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80.

The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 in a rotation direction indicated by arrow D78 in FIG. 1. The four primary transfer bias rollers 79Y, 79M, 79C, and 79K sandwich the intermediate transfer belt 78 together with the four photoconductor drums 5Y, 5M, 5C, and 5K, respectively, thus forming the four primary transfer nips between the intermediate transfer belt 78 and the photoconductor drums 5Y, 5M, 5C, and 5K.

The primary transfer bias rollers 79Y, 79M, 79C, and 79K are applied with a primary transfer bias having a polarity opposite a polarity of electric charge of toner. The intermediate transfer belt 78 is moved in the direction indicated by arrow D78 and sequentially passes through the primary transfer nips formed by the primary transfer bias rollers 79Y, 79M, 79C, and 79K. The yellow, magenta, cyan, and black toner images on the photoconductor drums 5Y, 5M, 5C, and 5K are primarily transferred to and superimposed on the intermediate transfer belt 78, thereby forming the multicolor toner image. Subsequently, the yellow, magenta, cyan, and black toner images superimposed on the intermediate transfer belt 78 reach a secondary transfer position where a secondary transfer roller 89 is disposed opposite the intermediate transfer belt 78. At the secondary transfer position, the secondary transfer backup roller 82 sandwiches the intermediate transfer belt 78 together with the secondary transfer roller 89, thus forming a secondary transfer nip between the secondary transfer roller 89 and the intermediate transfer belt 78.

The yellow, magenta, cyan, and black toner images superimposed on the intermediate transfer belt 78 are secondarily transferred onto a recording medium P conveyed through the secondary transfer nip in a secondary transfer process. After the secondary transfer process, a certain amount of untransferred toner, which is not transferred to the recording medium P, remains on the intermediate transfer belt 78. The intermediate transfer belt 78 reaches a position opposite the intermediate transfer belt cleaner 80. At the position, the intermediate transfer belt cleaner 80 collects the residual toner from the intermediate transfer belt 78. Thus, a sequence of image transfer processes performed on the intermediate transfer belt 78 is completed. The recording medium P is conveyed from a sheet feeder 12 disposed in a lower portion of the image forming apparatus 1 to the secondary transfer nip via a sheet feeding roller 97, a registration roller pair 98, and the like.

The sheet feeder 12 contains multiple recording media P such as sheets piled one on another. As the sheet feeding roller 97 rotates counterclockwise in FIG. 1, the sheet feeding roller 97 feeds an uppermost recording medium P in the sheet feeder 12 to a roller nip between the registration roller pair 98. The registration roller pair 98 stops rotating temporarily, stopping the recording medium P with a leading edge of the recording medium P nipped in the roller nip between the registration roller pair 98. Then, the registration roller pair 98 rotates to convey the recording medium P to the secondary transfer nip, timed to coincide with the arrival of the multicolor toner image on the intermediate transfer belt 78. As the recording medium P is conveyed through the secondary transfer nip, the color toner image formed on the intermediate transfer belt 78 is secondarily transferred onto the recording medium P. Thereafter, the recording medium P transferred with the color toner image at the secondary transfer nip is conveyed to a fixing device 20.

In the fixing device 20, a fixing belt 21 and a pressure roller 31 apply heat and pressure to the recording medium P to fix the transferred color toner image on the recording medium P. Thereafter, the recording medium P bearing the fixed toner image is conveyed through a roller nip formed by an output roller pair 99 and ejected by the output roller pair 99 onto an outside of the image forming apparatus 1. The recording media P ejected by the output roller pair 99 onto the outside of the image forming apparatus 1 are sequentially stacked as output images on a stack section 100. Thus, a series of image forming processes performed by the image forming apparatus 1 is completed.

Figure 2:
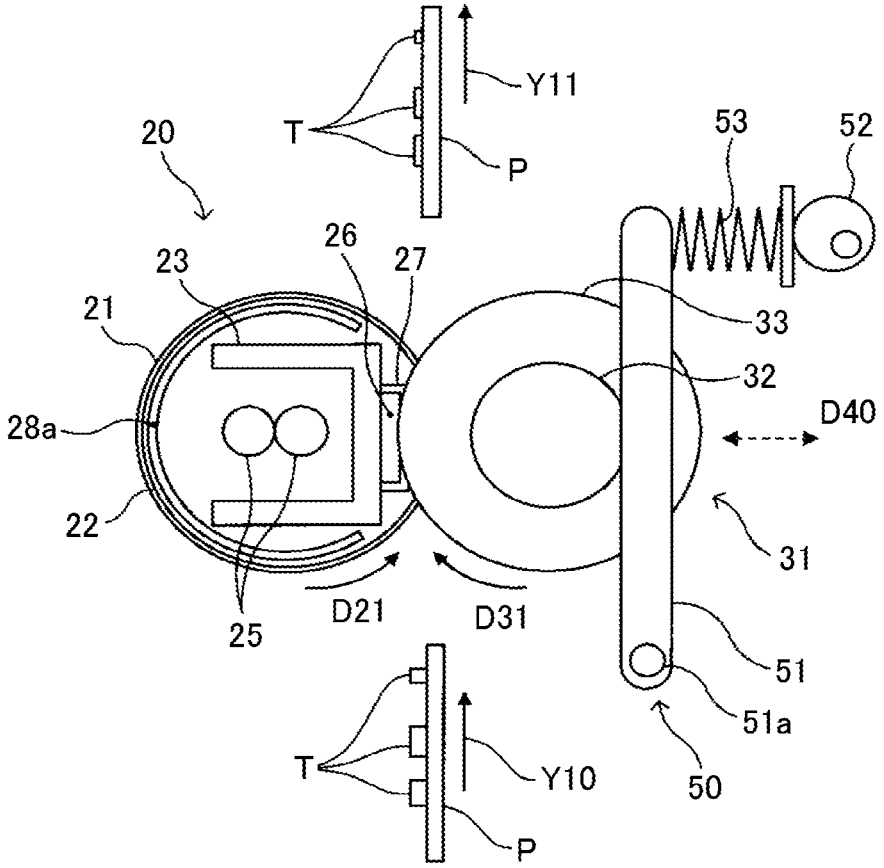
FIG. 2 is an explanatory view illustrating a schematic configuration of a fixing device.

Next, with reference to FIG. 2, a description is given of a configuration and operation of the fixing device 20 disposed in the image forming apparatus 1.

FIG. 2 is an explanatory view illustrating a schematic configuration of the fixing device 20.

As illustrated in FIG. 2, the fixing device 20 includes a fixing belt 21 that is a belt as a first rotator, a nip formation pad 26, a thermal conduction aid 27 that is a thermal conduction member, a heating member 22, a stay 23, a heater 25 as a heat source, a pressure roller 31 that is a pressing rotator as a second rotator, a temperature sensor, a contact-separation mechanism 50, and the like.

The fixing belt 21 is a thin, flexible endless belt rotatable counterclockwise in FIG. 2 in a rotation direction indicated by arrow D21. The fixing belt 21 includes a base layer, an elastic layer, and a release layer successively layered from the inner circumferential surface and has a total thickness set not greater than 1 mm.

The base layer of the fixing belt 21 has a thickness in a range of from 30 μm to 100 μm and is made of metal, such as nickel or stainless steel, or resin such as polyimide. The elastic layer of the fixing belt 21 has a thickness of 100 μm to 300 μm and is made of rubber such as silicone rubber, foamable silicone rubber, or fluoro rubber. The elastic layer absorbs slight surface asperities of the fixing belt 21 at a fixing nip N formed between the fixing belt 21 and the pressure roller 31, facilitating even heat conduction from the fixing belt 21 to a toner image T on a recording medium P and thereby suppressing formation of an orange peel image on the recording medium P.

The release layer of the fixing belt 21 has a thickness in a range of from 10 μm to 50 μm and is made of material such as tetrafluoroethylene-perfluoroalkylvinylether copolymer (PFA), polytetrafluoroethylene (PTFE), polyimide, polyether imide, and polyether sulfone (PES). The release layer facilitates separation or peeling-off of toner of the toner image T on the recording medium P from the fixing belt 21. A loop diameter of the fixing belt 21 is in a range of from 15 mm to 120 mm. In the present embodiment, the loop diameter of the fixing belt 21 is set about 30 mm.

Guide portions 28*a* of belt holders 28 as guides (see FIG. 3) are inserted into both ends of the fixing belt 21 in a width direction of the fixing belt 21. The guide portions 28*a* guide the fixing belt 21, that is, guide a rotation trajectory of the fixing belt 21, and hold the fixing belt 21 rotatable.

The pressure roller 31 contacts an outer circumferential surface of the fixing belt 21 at the fixing nip N, has a diameter in a range of from 30 mm to 40 mm, and is constructed of a hollow core bar 32 and an elastic layer 33 formed on the core bar 32. The elastic layer 33 of the pressure roller 31 is made of material such as foamable silicone rubber, silicone rubber, or fluoro rubber. A thin release layer made of PFA, PTFE or the like may be provided on the surface of the elastic layer 33. The pressure roller 31 is pressed against the fixing belt 21 to form a desired nip between the fixing belt 21 and the pressure roller 31.

The nip formation pad 26 is made of heat resistant resin such as liquid crystal polymer. An elastic member made of silicone rubber, fluoro rubber, or the like that is interposed between the nip formation pad 26 and the fixing belt 21 causes the outer circumferential surface of the fixing belt 21 to absorb slight surface asperities of the recording medium P at the fixing nip N, facilitating even heat conduction from the fixing belt 21 to the toner image T on the recording medium P and thereby preventing formation of a faulty toner image like an orange peel on the recording medium P.

The nip formation pad 26 has a concave cross-section that has a surface facing the pressure roller 31 and having a curve along the pressure roller 31. Accordingly, the recording medium P is curved along the curve of the pressure roller 31 as the recording medium P is ejected from the fixing nip N, preventing a failure in which the recording medium P ejected from the fixing nip N adheres to the fixing belt 21 and thereby does not separate from the fixing belt 21.

In FIG. 2, the nip formation pad 26 to form the fixing nip N has the concave cross-section. Alternatively, the nip formation pad 26 may have a planar surface or a surface gradually changing from a planar surface to a recessed surface. Adjusting the shape of the nip formation pad 26 so that the fixing nip N is substantially parallel to a surface bearing the toner image T on the recording medium P prevents the sheet P from creasing.

As the nip formation pad 26 is curved in the cross-section to produce a recess, the nip formation pad 26 facilitates adhesion of the fixing belt 21 to the recording medium P, enhancing fixing property of heating the fixing belt 21 quickly. Additionally, a curvature of the fixing belt 21 at an exit of the fixing nip N is greater than that of the pressure roller 31, facilitating separation of the recording medium P ejected from the fixing nip N from the fixing belt 21.

The thermal conduction aid 27 is made of material having a thermal conductivity higher than a thermal conductivity of the nip formation pad 26 and disposed between the nip formation pad 26 and the fixing belt 21. The thermal conduction aid 27 transfer heat to reduce a variation of temperature of the fixing belt 21. The thermal conduction aid 27 can reduce the temperature difference of the fixing belt 21 in the fixing nip N. Accordingly, the thermal conduction aid 27 prevents variation in gloss from appearing on the toner image T on the recording medium P. The thermal conduction aid 27 is fixed to the nip formation pad 26 and covers the surface of the nip formation pad 26 facing the inner circumferential surface of the fixing belt 21.

Preferably, the thermal conduction aid 27 is made of metal, particularly, copper, aluminum, silver, or the like having high thermal conductivity. Aluminum is particularly preferable because it is excellent in cost and workability. The thermal conduction aid 27 made of metal can reinforce the strength of the nip formation pad 26.

Since the fixing belt 21 slides on the thermal conduction aid 27, a surface of the thermal conduction aid 27 may be coated with material having good slidability, such as PTFE, to reduce a torque and wear of the fixing belt 21.

The heating member 22 is a pipe having a thickness not greater than 0.2 mm. The heating member 22 may be made of metal having heat conductivity such as aluminum, iron, and stainless steel. Setting the thickness of the heating member 22 not greater than 0.2 mm can improve heating efficiency of the heating member 22 and, as a result, improve heating efficiency of the fixing belt 21.

In the heating member 22, a portion of the pipe corresponding to the fixing nip N is removed to form an opening, and a portion of the pipe not corresponding to the fixing nip N is adjacent to or in contact with the inner circumferential surface of the fixing belt 21. In other words, the heating member has a recessed portion having the opening toward the fixing nip N.

A gap A between the fixing belt 21 and the heating member 22 under an ordinary temperature, which is the gap at the portion not corresponding to the fixing nip N, is preferably greater than 0 mm and 1 mm or less, that is, $0\ \text{mm} < A \leq 1\ \text{mm}$. Setting the gap as described above prevents a contact area of the fixing belt 21 that slides on the heating member 22 from increasing too much and prevents an acceleration of the wear of the fixing belt 21. Additionally, the gap prevents a degradation in heating efficiency of the fixing belt 21 caused by separating the fixing belt 21 from the heating member 22 too far.

Since the heating member 22 disposed close to the fixing belt 21 supports the tube shape of the fixing belt 21 having flexibility to some extent, the heating member 22 can prevent deterioration and damage due to deformation of the fixing belt 21.

In order to decrease sliding friction between the heating member 22 and the fixing belt 21, a sliding contact surface of the heating member 22, that is, an outer circumferential surface of the heating member 22 may be made of material having a small friction coefficient, or the inner circumferential surface 21*a* of the fixing belt 21 may be coated with a surface layer made of material containing fluorine. As illustrated in FIG. 2, the heating member 22 is substantially circular in the cross-section. Alternatively, the heating member 22 may be polygonal in the cross-section.

If the fixing device 20 includes a separate component that conducts heat from the heater 25 to the fixing belt 21 evenly and stabilizes motion of the fixing belt 21 as the fixing belt 21 is driven, the fixing device 20 may employ a direct heating method in which the heater 25 heats the fixing belt 21 directly without the heating member 22. In this case, the fixing device 20 reduces its total thermal capacity by a thermal capacity of the heating member 22, heating the fixing belt 21 quickly and saving energy.

Both ends of the heating member 22 in the longitudinal direction are supported and fixed by side plates of the fixing device 20. Radiant heat and radiant light from the heater 25 as a heat source heats the heating member 22, and the heating member 22 heats the fixing belt 21. That is, the heater 25 as a heating device directly heats the heating member 22 and indirectly heats the fixing belt 21 via the heating member 22.

Output of the heater 25 is controlled based on the temperature of the outer circumferential surface of the fixing belt 21 detected by the temperature sensor. The temperature sensor is a thermopile, a thermistor or the like disposed opposite the outer circumferential surface of the fixing belt 21.

The heater 25 controlled as described above heats the fixing belt 21 to a desired fixing temperature. As described above, in the fixing device 20, The heating member 22 does not heat a part of the fixing belt 21 locally but does heat the fixing belt 21 in a substantial entire span of the fixing belt 21 in a circumferential direction of the fixing belt 21. Accordingly, even if the fixing belt 21 rotates at high speed, the heating member 22 heats the fixing belt 21 sufficiently and can prevent an occurrence of a fixing failure.

FIG. 2 illustrates a halogen heater used as the heater 25. Alternatively, other heaters may be used as the heater 25. For example, the heater 25 may be an induction heater.

As illustrated in FIG. 2, the stay 23 is fixed inside a loop of the fixing belt 21 to reinforce the nip formation pad 26 that forms the fixing nip N. The stay 23 has a length in a longitudinal direction thereof that is equivalent to a length of the nip formation pad 26 in the longitudinal direction thereof. The stay 23 is mounted on and supported by the side plate of the fixing device 20 at each lateral end of the stay 23 in the longitudinal direction thereof. The stay 23 contacts the pressure roller 31 via the nip formation pad 26 and the fixing belt 21 and receives the pressing force from the pressure roller 31 at the fixing nip N to prevent a large deformation of the nip formation pad 26 caused by the pressing force at the fixing nip N.

Preferably, the stay 23 is made of metal having an increased mechanical strength, such as stainless steel or iron, to attain the advantages described above.

If the heater 25 is a halogen heater or the like that heats the fixing belt 21 by radiant heat, an opposed face of the stay 23 disposed opposite the heater 25 may be partially or entirely coated with an insulator or treated with bright annealing (BA) or mirror polishing. The above processing results in the use of the radiant heat radiated from the heater 25 to the stay 23 (that is, the radiant heat that heats the stay 23) to heat the heating member 22 and further improves the heating efficiency of the heating member 22 and the fixing belt 21.

A gear is set on the pressure roller 31 and engages a driving gear of a driver so that the pressure roller 31 is driven and rotated clockwise in FIG. 2 in a rotation direction indicated by arrow D31. Both ends of the pressure roller 31 in a longitudinal direction thereof are rotatably supported by the side plates of the fixing device 20 through bearings, respectively. Optionally, a heater such as a halogen heater may be situated inside the pressure roller 31.

If the elastic layer 33 of the pressure roller 31 is made of sponge such as silicone rubber foam, the elastic layer 33 decreases pressure exerted to the fixing nip N, reducing bending of the nip formation pad 26. Additionally, the elastic layer 33 made of sponge enhances thermal insulation of the pressure roller 31, reducing heat conduction from the fixing belt 21 to the pressure roller 31 and thereby improving heating efficiency in heating the fixing belt 21.

As illustrated in FIG. 2, the loop diameter of the fixing belt 21 is equivalent to the diameter of the pressure roller 31. Alternatively, the loop diameter of the fixing belt 21 may be smaller than the diameter of the pressure roller 31. In this case, a curvature of the fixing belt 21 is greater than a curvature of the pressure roller 31 at the fixing nip N, facilitating separation of the recording medium P from the fixing belt 21 when the recording medium P is ejected from the fixing nip N.

Yet alternatively, the loop diameter of the fixing belt 21 may be greater than the diameter of the pressure roller 31. Regardless of a relation between the loop diameter of the fixing belt 21 and the diameter of the pressure roller 31, pressure from the pressure roller 31 is not exerted to the heating member 22.

The fixing device 20 includes a contact-separation mechanism 50 that contacts or separates the pressure roller 31 with respect to the fixing belt 21. Specifically, the contact-separation mechanism 50 includes a pressure lever 51, an eccentric cam 52, a pressure spring 53, and the like.

The pressure lever 51 is pivotably mounted on and supported by the side plate of the fixing device 20 such that the pressure lever 51 is pivotable about a support shaft 51*a* at one end of the pressure lever 51 in a longitudinal direction thereof. A center of the pressure lever 51 in the longitudinal direction thereof contacts the bearing of the pressure roller 31. The bearing of the pressure roller 31 is movably held in a slot formed in the side plate.

Another end of the pressure lever 51 in the longitudinal direction thereof is anchored with the pressure spring 53 anchored to a holder plate with which the eccentric cam 52 is engaged. The eccentric cam 52 is configured to be rotatable by a drive motor.

In the above-described configuration, rotations of the eccentric cam 52 pivots the pressure lever 51 about the support shaft 51*a* and moves the pressure roller 31 in a direction indicated by the dashed arrow D40 in FIG. 2. During a fixing process to fix the toner image T on the recording medium P, the eccentric cam 52 is at a pressurization position in a rotation direction of the eccentric cam 52 as illustrated in FIG. 2, and the pressure roller 31 is at a pressing position to press the fixing belt 21 and form the fixing nip N.

Conversely, during times other than the fixing process, for example, while a user removes the sheet P jammed in the fixing device 20 or the fixing device 20 is in a standby mode, the eccentric cam 52 is rotated from the pressurization position illustrated in FIG. 2 by 180 degrees and the pressure roller 31 is at a non-pressing position at which the pressure roller 31 separates from the fixing belt 21 or presses the fixing belt 21 with a decreased pressure.

A description is provided of a regular fixing process to fix the toner image T on the sheet P, which is performed by the fixing device 20 having the construction described above. As the image forming apparatus 1 is powered on, the heater 25 is supplied with power and the driver starts driving and rotating the pressure roller 31 clockwise in FIG. 2 in a direction indicated by arrow D31. The rotation of the pressure roller 31 drives the fixing belt 21 to rotate in a direction indicated by arrow D21 as illustrated in FIG. 2 by friction between the fixing belt 21 and the pressure roller 31.

Thereafter, the recording medium P is fed from the sheet feeder 12, the color toner image is transferred onto the recording medium P at the position of the secondary transfer roller 89 and becomes the unfixed color image beard on the recording medium P. As illustrated in FIG. 2, the recording medium P bearing the unfixed toner image T is conveyed in a direction Y10 while the recording medium P is guided by a guide plate and enters the fixing nip N formed between the fixing belt 21 and the pressure roller 31 pressed against the fixing belt 21.

The toner image T is fixed on a surface of the recording medium P under heat from the fixing belt 21 heated by the heater 25 and the heating member 22 and pressure exerted from the nip formation pad 26 and the pressure roller 31 pressed against the nip formation pad 26 supported by the stay 23. Thereafter, the recording medium P is ejected from the fixing nip N and conveyed in a recording medium conveyance direction Y11.

Figure 3:
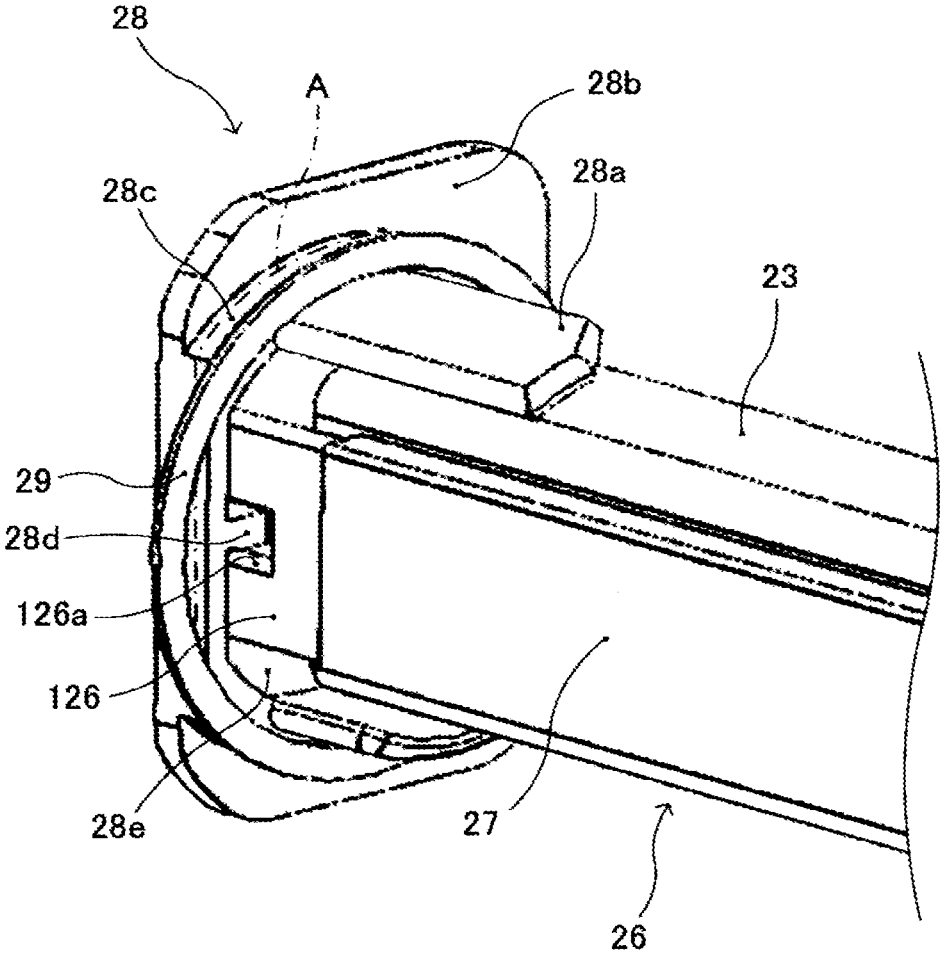
FIG. 3 is a perspective view illustrating a belt holder, a nip formation pad, and a stay.
Figure 4A:
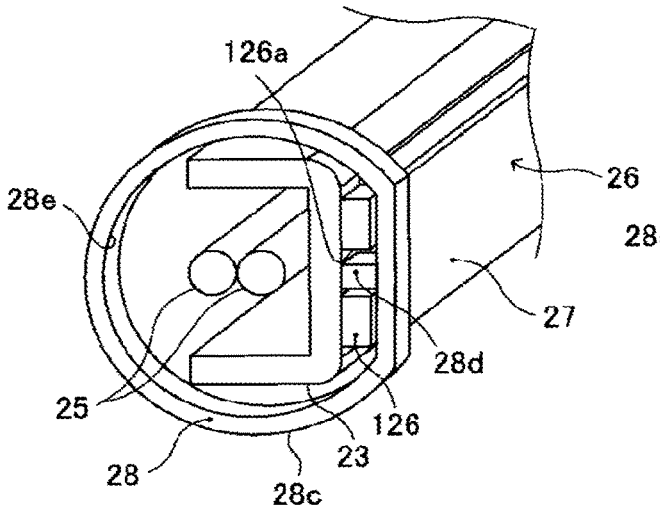
FIG. 4A is a schematic cross-sectional view with a schematic perspective view illustrating a portion indicated by a dash-dot-dash line in FIG. 3 when a fixing belt is not set.
Figure 4B:
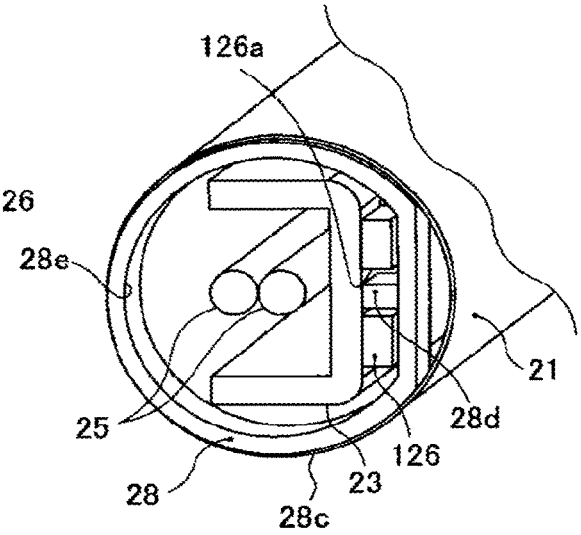
FIG. 4B is a schematic cross-sectional view with a schematic perspective view illustrating the portion indicated by a dash-dot-dash line in FIG. 3 when the fixing belt is set.

FIG. 3 is a perspective view illustrating the belt holder 28, the nip formation pad 26, and the stay 23. FIG. 4A is a schematic cross-sectional view with a schematic perspective view illustrating a portion indicated by a dash-dot-dash line A in FIG. 3 when the fixing belt 21 is not set, and FIG. 4B is the schematic cross-sectional view with the schematic perspective view illustrating the portion indicated by the dash-dot-dash line A in FIG. 3 when the fixing belt 21 is set.

The belt holders 28 arranged at both ends of the fixing belt 21 in the width direction have the same shape. The belt holder 28 includes an attachment portion 28*b* attached to the side plate of the fixing device 20 and a guide portion 28*a* facing one end of the inner circumferential surface of the fixing belt 21.

The guide portion 28*a* has a substantially cylindrical shape that is cut out a portion facing the pressure roller 31. The guide portion 28*a* has an outer diameter substantially equivalent to an inner diameter of the fixing belt 21 and projects in the axial direction of the fixing belt 21 to enter a predetermined length from the end of the fixing belt 21. In other words, the guide portion 28*a* is a circumferential guide projection. Inserting the guide portions 28*a* into the both ends of the fixing belt 21 sliding on the guide portions 28*a* guides a rotation trajectory of the fixing belt 21 and maintains a sectional shape of the fixing belt 21 to be a circular shape.

In addition, the belt holder 28 has a flange portion 28*c* outside from the guide portion 28*a*. A sectional shape of the flange portion 28*c* has a line portion facing the pressure roller 31 and a substantially circular portion other than the line portion. The attachment portion 28*b* has a through hole 28*e* disposed at a position corresponding to the inside of the flange portion 28*c*, and the stay 23 and the heater 25 are attached to the side plate of the fixing device 20 through the through hole 28*e*.

A slip ring 29 to protect the end of the fixing belt 21 is rotatably held between the flange portion 28*c* and the guide portion 28*a*. The slip ring 29 faces the end of the fixing belt 21 and prevents the end of the fixing belt 21 from directly contacting the end surface of the flange portion 28*c* when the fixing belt 21 is skewed in the axial direction. When the end of the fixing belt 21 comes into contact with the slip ring 29, the slip ring 29 rotates together with the fixing belt 21 and reduces a wear and damage of the end of the fixing belt 21. The slip ring 29 may be made of material having a smaller friction coefficient with the fixing belt 21 than the flange portion 28*c* and may not rotate together with the fixing belt 21 when the slip ring 29 comes into contact with the end of the fixing belt 21. The above-described configuration can also reduce the wear and damage of the end of the fixing belt 21.

Additionally, the belt holder 28 has a preventive projection 28*d* for errors in attachment on the inner circumferential surface facing the pressure roller 31 in the through hole 28*e* (which is also the inner circumferential surface of the flange portion 28*c*) to avoid errors in attachment of the nip formation pad 26.

The nip formation pad 26 has hold portions 126 held by the belt holder 28 at both ends in an axial direction of the nip formation pad 26. The hold portion 126 at one end of the nip formation pad 26 has a preventive groove 126*a* for errors in attachment at an end of the hold portion 126. The preventive groove 126*a* for errors in attachment is formed at a center of the end in a transverse direction of the nip formation pad 26.

On the other hand, the hold portion 126 at the other end of the nip formation pad 26 does not have the preventive groove 126*a* for errors in attachment. In the above-described configuration, when the nip formation pad 26 that is mistakenly set one end and the other end in the axial direction is inserted into the through hole 28*e* of the belt holder 28, the preventive projection 28*d* for errors in attachment abuts the nip formation pad 26 and prevents the nip formation pad 26 from being inserted into the through hole 28*e*. On the other hand, when the nip formation pad 26 that is correctly set one end and the other end in the axial direction is inserted into the through hole 28*e* of the belt holder 28, the preventive projection 28*d* for errors in attachment is inserted into the preventive groove 126*a* for errors in attachment, and both ends of the nip formation pad 26 are inserted into the corresponding through holes 28*e*. Therefore, the above-described configuration prevents errors in attachment of the nip formation pad 26.

In the present embodiment, the length in the transverse direction of the preventive groove 126*a* for errors in attachment is sufficiently longer than the length in the transverse direction of the preventive projection 28*d* for errors in attachment so that the preventive projection 28*d* for errors in attachment does not contact the preventive groove 126*a* after the assembly of the nip formation pad 26.

Figure 5:
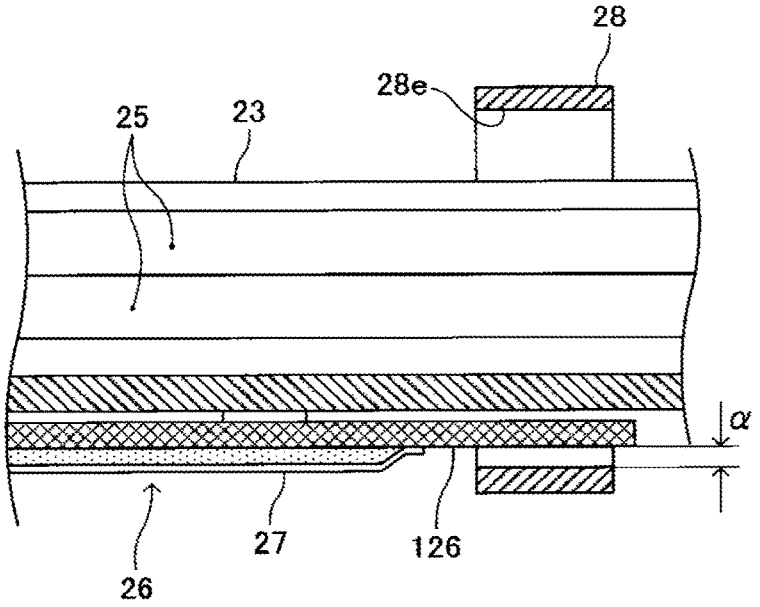
FIG. 5 is a schematic vertical cross-sectional view illustrating a portion near the belt holder.

FIG. 5 is a schematic vertical cross-sectional view illustrating a portion near the belt holder 28.

As illustrated in FIG. 5, the hold portion 126 of the nip formation pad 26 is inserted into the through hole 28*e* of the belt holder 28 with a gap $\alpha$. Therefore, the nip formation pad 26 is held by the belt holder 28 to be movable within the gap $\alpha$ in the thickness direction of the nip formation pad 26 that is also a pressing direction of the pressure roller 31.

Figure 6:
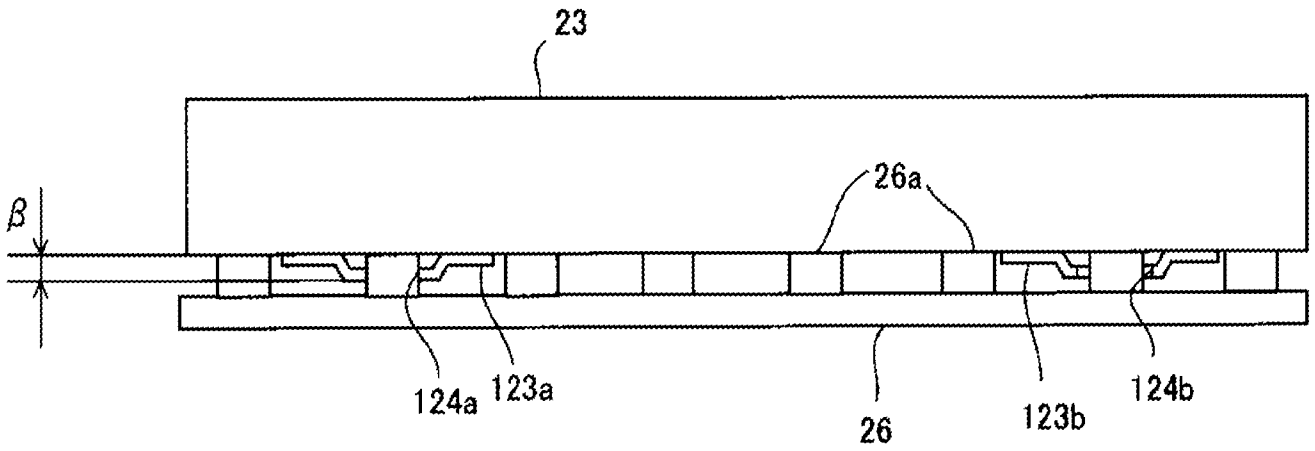
FIG. 6 is a schematic view illustrating a stay and a nip formation pad.

FIG. 6 is a schematic view illustrating the stay 23 and the nip formation pad 26.

As illustrated in FIG. 6, on the surface of the nip formation pad 26 facing the stay 23, two projection groups each including a plurality of projections 26*a* arranged side by side in the longitudinal direction at predetermined intervals are arranged in two rows in the transverse direction of the nip formation pad 26 that is a vertical direction of the sheet surface in FIG. 6.

Two positioning members 123*a* and 123*b* to position the nip formation pad 26 in the longitudinal direction are attached to the opposing surface of the stay 23 facing the nip formation pad 26 with a predetermined distance in the longitudinal direction. Each of positioning members 123*a* and 123*b* has each of positioning holes 124*a* and 124*b*, respectively, and the projection 26*a* passes through the positioning hole.

The positioning member 123*a* on the left side in FIG. 6 is designed as the main reference for positioning, and the shape of the positioning hole 124*a* is a substantially same outer shape of the projection 26*a*. On the other hand, the positioning member 123*b* on the right side in FIG. 6 is designed as a sub-reference for positioning, and the length of the positioning hole 124*b* in the longitudinal direction is longer than the length of the projection 26*a* in the longitudinal direction.

One of the plurality of projections 26*a* of the nip formation pad 26 penetrates the positioning hole 124*a* of the positioning member 123*a* at one end of the stay 23, and another one penetrates the positioning hole 124*b* of the positioning member 123*b* at the other end of the stay 23 to position the nip formation pad 26 with respect to the stay 23 in the longitudinal direction and the transverse direction. When the pressure roller 31 is pressed against the nip formation pad 26, the plurality of projections 26*a* abut against the stay 23 to position the nip formation pad 26 in the pressing direction of the pressure roller 31 that is also the thickness direction of the nip formation pad 26.

Positioning the nip formation pad 26 in the longitudinal direction and the transverse direction as described above can prevent the preventive projection 28*d* for errors in attachment of the belt holder 28 being inserted into the preventive groove 126*a* for errors in attachment of the nip formation pad 26 from contacting the nip formation pad 26.

In the present embodiment, as described above, the nip formation pad 26 is movably held in the thickness direction within a predetermined range (that is, the gap $\alpha$). In a dimensional relationship of the present embodiment, the projection 26*a* does not slip out of the positioning hole even if the nip formation pad 26 separates from the stay 23 by the maximum distance. Specifically, a movable amount of the nip formation pad 26 (that is, the gap $\alpha$) is smaller than an amount of fitting of the projection into the positioning hole illustrated by $\beta$ in FIG. 6, that is, the dimensional relationship $\alpha<\beta$ is satisfied.

Figure 7A:
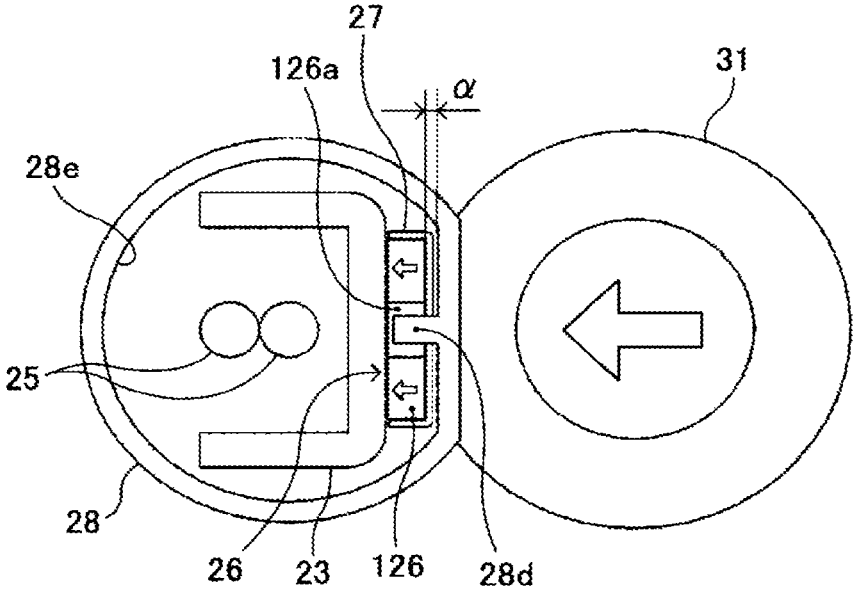
FIG. 7A is a schematic view illustrating a positional relationship between the nip formation pad and the belt holder when a pressure roller is located at a pressing position.
Figure 7B:
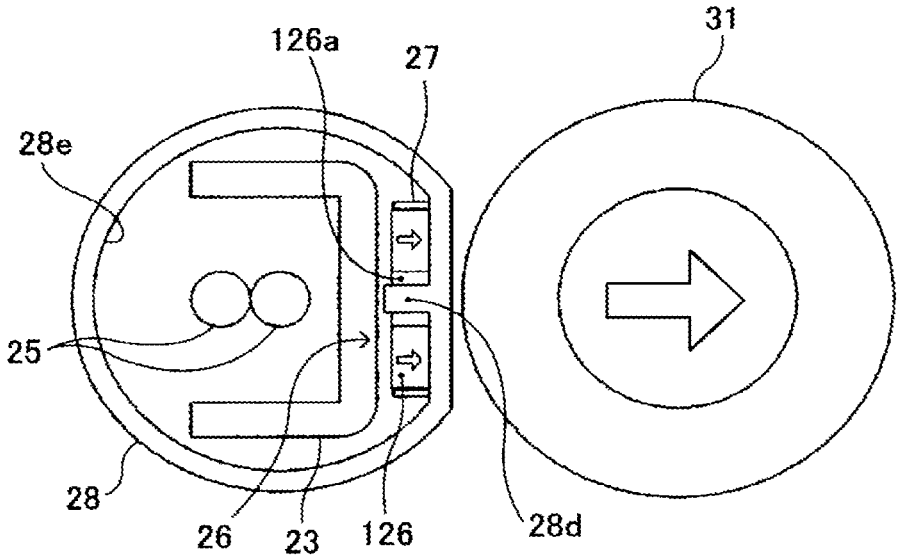
FIG. 7B is a schematic view illustrating a positional relationship between the nip formation pad and the belt holder when a pressure roller is located at a non-pressing position.

FIG. 7A is a schematic view illustrating a positional relationship between the nip formation pad 26 (the hold portion 126) and the belt holder 28 (the inner circumferential surface of the through hole 28*e*) when the pressure roller 31 is located at a pressing position, and FIG. 7B is a schematic view illustrating a positional relationship between the nip formation pad 26 (the hold portion 126) and the belt holder 28 (the inner circumferential surface of the through hole 28*e*) when the pressure roller 31 is located at a non-pressing position.

As illustrated in FIG. 7A, when the pressure roller 31 forms the nip in the pressing position during warming up and the fixing process, the nip formation pad 26 receives a load from the pressure roller 31 in a direction indicated by arrow in FIG. 7A via the fixing belt 21 and the thermal conduction aid 27. As a result, the pressure roller 31 presses the nip formation pad 26 against the stay 23, the projection 26*a* of the nip formation pad 26 contacts the stay 23 (see FIG. 6), and the stay 23 as a movement restrictor restricts a movement of the nip formation pad 26 in the pressing direction of the pressure roller 31. That is, when the pressure roller 31 is at the pressing position, the nip formation pad 26 is sandwiched between the stay 23 and the pressure roller 31 and held by the stay 23 and the pressure roller 31.

As is clear from FIG. 7A, since the pressure roller 31 presses the nip formation pad 26 against the stay 23, the hold portion 126 separates from the inner circumferential surface of the through hole 28*e* of the belt holder 28. (See the gap $\alpha$ in FIG. 7A). As a result, the nip formation pad 26 is not in contact with the belt holder 28 during warming up and the fixing process.

If the nip formation pad 26 is in contact with the belt holder 28 during warming up and the fixing process, the heat stored in the nip formation pad 26 transfers to the belt holder 28, and a temperature of an end portion of the nip formation pad 26 in the longitudinal direction thereof may be lower than a central portion of the nip formation pad 26. As a result, an image fixing failure may occur at both end portions of the recording medium in a width direction of the recording medium. In particular, the thermal conduction aid 27 is disposed between the nip formation pad 26 and the fixing belt 21 to transfer heat in the longitudinal direction. The thermal conduction aid 27 transfers the heat of an end portion of the fixing belt 21 to the belt holder 28 and lowers the temperature of the end portion of the fixing belt 21. As a result, the image fixing failure may easily occur at both end portions of the recording medium in the width direction of the recording medium.

On the other hand, in the present embodiment, the nip formation pad 26 is not in contact with the belt holder 28 and sandwiched between the stay 23 and the pressure roller 31 during warming up and the fixing process. The above-described configuration in the present embodiment can stop transfer of the heat stored in the nip formation pad 26 to the belt holder 28 and prevent the temperature at both end portions in the longitudinal direction of the nip formation pad 26 from lowering. Therefore, the present embodiment can reduce the image fixing failure at both end portions of the recording medium in the width direction of the recording medium. Particularly, in the configuration including the thermal conduction aid 27 disposed between the nip formation pad 26 and the fixing belt 21 as in the present embodiment, the image fixing failure at both end portions of the recording medium in the width direction of the recording medium can be effectively reduced.

Additionally, in the present embodiment, the thermal conduction aid 27 fixed to the nip formation pad 26 is made of metal as described above. The thermal conduction aid 27 made of metal as described above can reinforce the nip formation pad 26, in addition to the original function of assisting the heat transfer of the fixing belt 21 in the width direction and uniforming temperatures of the fixing belt 21 in the width direction. The nip formation pad 26 reinforced by the thermal conduction aid 27 can have a sufficient strength against the load of the pressure roller 31.

On the other hand, as illustrated in FIG. 7B, when the pressure roller 31 does not form the nip at the non-pressing position, such as during jam processing, the nip formation pad 26 is not sandwiched between the pressure roller 31 and the stay 23. The nip formation pad 26 is held by the belt holder 28 and the stay 23 to be movable within a predetermined range in the pressing direction of the pressure roller 31 that is the thickness direction of the nip formation pad 26.

When the nip formation pad 26 moves toward the pressure roller 31 at the non-pressing position as indicated by arrows in FIG. 7B, the hold portion 126 of the nip formation pad 26 contacts the inner circumferential surface of the through hole 28*e* of the belt holder 28, and the movement of the nip formation pad 26 is restricted. The above-described configuration prevents the projections 26*a* (see FIG. 6) of the nip formation pad 26 from slipping out from the positioning holes 124*a* and 124*b* (see FIG. 6) of the stay 23 and can prevent the nip formation pad 26 from falling off.

Additionally, in the present embodiment, since the thermal conduction aid 27 is fixed to the nip formation pad 26, the above-described configuration can also prevent the thermal conduction aid 27 from falling out of the device when the pressure roller 31 is at the non-pressing position.

Figure 8:
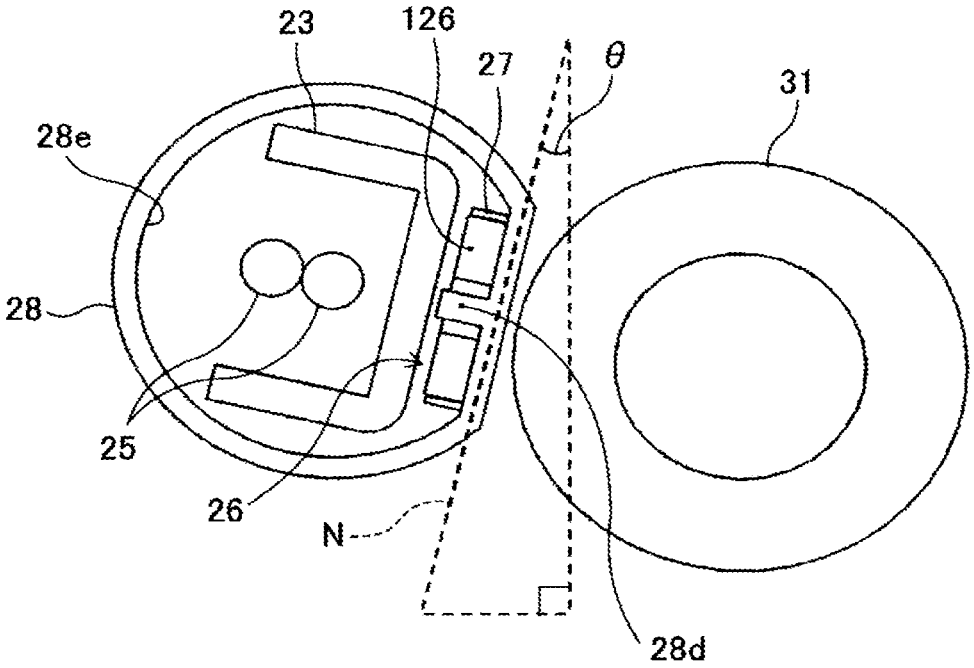
FIG. 8 is an explanatory view illustrating a structure including the nip formation pad having a nip formation surface inclined at a predetermined angle θ with respect to the vertical direction to face downward.

FIG. 8 is an explanatory view illustrating a structure including the nip formation pad having a nip formation surface inclined at a predetermined angle θ with respect to the vertical direction to face downward.

In a configuration illustrated in FIG. 8, when the pressure roller 31 is at the non-pressing position, a weight of the nip formation pad 26 acts toward the pressure roller 31. That is, when the pressure roller 31 is at the non-pressing position, the weight of the nip formation pad 26 moves the nip formation pad 26 toward the pressure roller 31 in a direction away from the stay 23. Particularly, in the configuration illustrated in FIG. 8 and including the thermal conduction aid 27 made of metal and fixed to the nip formation pad 26, a weight of the thermal conduction aid 27 is added to the weight of the nip formation pad 26. Therefore, the nip formation pad 26 easily moves toward the pressure roller 31.

The configuration of the present embodiment described above effectively functions when the weight of the nip formation pad 26 moves the nip formation pad 26 toward the pressure roller 31 at the non-pressing position in the direction away from the stay 23. Specifically, in the configuration, the inner circumferential surface of the through hole 28*e* that is a part of the belt holder 28 according to the present embodiment in a pressure roller side faces the hold portion 126 of the nip formation pad 26 and restricts the movement of the nip formation pad 26 toward the pressure roller 31.

As described above, hitting the hold portion 126 of the nip formation pad 26 moved toward the pressure roller 31 by the weight of the nip formation pad 26 against the inner circumferential surface of the through hole 28*e* of the belt holder 28 to restrict the movement due to the weight of the nip formation pad 26 can reliably prevent the nip formation pad 26 from falling off.

Figure 9:
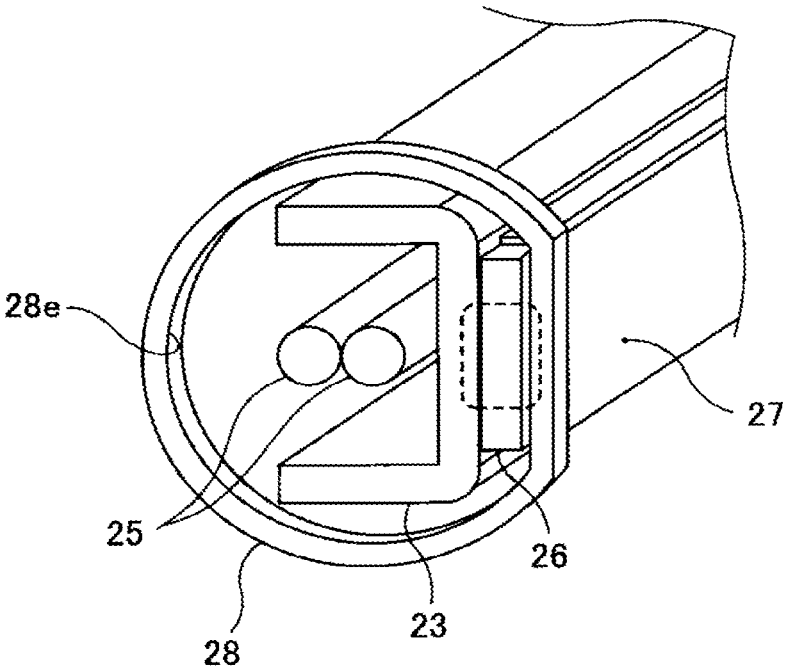
FIG. 9 is a cross-sectional view with a perspective view illustrating the fixing device without a preventive mechanism for errors in attachment.

Although the above-described fixing device 20 includes the preventive projection 28*d* for errors in attachment disposed on the inner circumferential surface of the through hole 28*e* of the belt holder 28 and the preventive groove 126*a* for errors in attachment disposed at the end portion of the nip formation pad 26 to avoid errors in attachment of the nip formation pad 26, the fixing device may not include the preventive projection 28*d* for errors in attachment and the preventive groove 126*a* for errors in attachment as illustrated in FIG. 9.

The embodiments described above are just examples, and the various aspects of the present disclosure attain respective effects as follows.

First Aspect

A fixing device such as the fixing device 20 according to a first aspect includes a first rotator such as the fixing belt 21 having an endless form, a second rotator such as the pressure roller 31 configured to move between a pressing position at which the second rotator presses the first rotator and a non-pressing position at which the second rotator does not press the first rotator, a heater such as the heater 25 arranged in at least one of the first rotator and the second rotator, a guide such as the belt holder 28 facing an end of the first rotator, and a nip formation pad such as the nip formation pad 26 that is in contact with the second rotator via the first rotator to form a nip between the second rotator and the nip formation pad. The nip formation pad is configured to separate from the guide when the second rotator is at the pressing position.

In one type of fixing device, both longitudinal ends of the nip formation pad are fixed to the belt holders. Therefore, in the fixing process, both ends of the nip formation pad are in contact with the belt holders. Accordingly, during the fixing process, the heat stored in the nip formation pad transfers from the longitudinal end portions of the nip formation pad to the belt holders, and the temperature of both end portions of the nip formation pad may be lower than the temperature of the central portion of the nip formation pad. As a result, the image fixing failure may occur at both end portions of the recording medium in the width direction of the recording medium.

On the other hand, in the first aspect, the nip formation pad is not in contact with the guide when the second rotator is at the pressing position at which the second rotator presses the first rotator. Accordingly, during the fixing process, the fixing device according to the first aspect reduces the heat transfer of the heat stored in the nip formation pad to the guide and the temperature decrease at the longitudinal end portion of the nip formation pad. As a result, the fixing device according to the first aspect can apply sufficient heat to the toner image on both axial end portions of the recording medium passing through the nip and reduce the image fixing failure at the both end portions of the recording medium.

Second Aspect

In addition to the fixing device such as the fixing device 20 according to the first aspect, the fixing device according to a second aspect includes a movement restrictor such as the stay 23 configured to restrict a movement of the nip formation pad such as the nip formation pad 26 in a pressing direction in which the second rotator such as the pressure roller 31 presses the first rotator such as the fixing belt 21. The nip formation pad is configured to be movable in a predetermined range with respect to the guide. When the second rotator is at the pressing position, the nip formation pad is configured to be sandwiched between the movement restrictor and the second rotator.

According to the second aspect, as described in the embodiment, the nip formation pad such as the nip formation pad 26 does not contact the guide such as the belt holder 28 when the second rotator such as the pressure roller 31 is at the pressing position.

Third Aspect

In the fixing device according to a third aspect, in addition to the fixing device according to the second aspect, when the second rotator such as the pressure roller 31 is at the non-pressing position, the movement restrictor such as the stay 23 and the guide such as the belt holder 28 hold the nip formation pad such as the nip formation pad 26 to be movable in the predetermined range.

As described in the embodiment, the fixing device according to the third aspect can prevent the nip formation pad from falling off the device when the second rotator is at the non-pressing position.

Fourth Aspect

In the fixing device according to a fourth aspect, in addition to the fixing device according to the third aspect, the nip formation pad such as the nip formation pad 26 is configured to move toward the second rotator such as the pressure roller 31 due to the weight of the nip formation pad, and contact between the nip formation pad and the guide such as the belt holder 28 restricts a movement of the nip formation pad due to the weight of the nip formation pad.

According to the fourth aspect, as described with reference to FIG. 8, the guide such as the belt holder 28 restricts the movement of the nip formation pad due to its own weight and can prevent the nip formation pad from falling out of the device due to its own weight.

Fifth Aspect

In addition to the fixing device such as the fixing device 20 according to any one of from the first aspect to the fourth aspect, the fixing device according to a fifth aspect includes a thermal conduction aid such as the thermal conduction aid 27 disposed between the nip formation pad such as the nip formation pad 26 and the first rotator such as the fixing belt 21 and having a higher heat conductivity than that of the nip formation pad.

According to the fifth aspect, as described in the embodiment, the thermal conduction aid such as the thermal conduction aid 27 can facilitate the heat transfer in the first rotator such as the fixing belt 21 in the rotation axis direction of the first rotator and uniform the temperature distribution in the rotation axis direction of the first rotator.

In addition, as described in the embodiment, the temperature decrease at the axial end portion of the nip formation pad such as the nip formation pad 26 causes the thermal conduction aid disposed on the nip formation pad to transfer the heat of the axial end portion of the first rotator to the nip formation pad, decreases the temperature at the axial end portion of the first rotator, and may cause the image fixing failure at the axial end portion of the recording medium. However, in the fifth aspect, since the temperature decrease at the axial end portion of the nip formation pad such as the nip formation pad 26 can be prevented, the image fixing failure at the axial end portion of the recording medium can be effectively prevented.

Sixth Aspect

In the fixing device according to a sixth aspect, in addition to the fixing device according to the fifth aspect, the thermal conduction aid such as the thermal conduction aid 27 is fixed to the nip formation pad such as the nip formation pad 26.

According to the sixth aspect, as described in the embodiment, the nip formation pad can prevent the thermal conduction aid such as the thermal conduction aid 27 from falling off the device.

Seventh Aspect

In the fixing device according to a seventh aspect, in addition to the fixing device according to the fifth or sixth aspect, the thermal conduction aid such as the thermal conduction aid 27 is made of metal.

According to the seventh aspect, as described in the embodiment, the thermal conduction aid can reinforce the nip formation pad such as the nip formation pad 26.

Eighth Aspect

The image forming apparatus according to an eighth aspect includes an image forming device such as one of the image forming devices 4Y, 4M, 4C, and 4K configured to form the toner image on the recording medium using toner and the fixing device according to any one of from the first aspect to the seventh aspect to fix the toner image on the recording medium.

According to the eighth aspect, the image forming apparatus can decrease the image fixing failure at the end portion of the recording medium in the width direction and form a good image.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device, comprising:

a first rotator having an endless form;

a second rotator configured to move between a pressing position at which the second rotator presses the first rotator and a non-pressing position at which the second rotator does not press the first rotator;

a heater arranged in at least one of the first rotator and the second rotator;

a guide facing an end of the first rotator;

a nip formation pad that is in contact with the second rotator via the first rotator to form a nip between the second rotator and the nip formation pad, the nip formation pad being configured to separate from the guide when the second rotator is at the pressing position; and a movement restrictor configured to restrict a movement of the nip formation pad in a pressing direction in which the second rotator presses the first rotator, wherein the nip formation pad is configured to be movable in a predetermined range with respect to the guide, wherein, when the second rotator is at the pressing position, the nip formation pad is configured to be sandwiched between the movement restrictor and the second rotator, wherein, when the second rotator is at the non-pressing position, the movement restrictor and the guide hold the nip formation pad to be movable in the predetermined range, wherein the nip formation pad is configured to move toward the second rotator due to a weight of the nip formation pad, and wherein contact between the nip formation pad and the guide restricts a movement of the nip formation pad due to the weight of the nip formation pad.

2. The fixing device according to claim 1, further comprising a thermal conduction aid disposed between the nip formation pad and the first rotator and having a higher heat conductivity than a heat conductivity of the nip formation pad.

3. The fixing device according to claim 2, wherein the thermal conduction aid is fixed on the nip formation pad.

4. The fixing device according to claim 2, wherein the thermal conduction aid is made of metal.

5. An image forming apparatus comprising:

an image forming device configured to form a toner image on a recording medium using toner; and the fixing device according to claim 1, wherein the fixing device is configured to fix the toner image on the recording medium.

* * * * *